US005351879A

United States Patent [19]

Liu et al.

[11] Patent Number: 5,351,879

[45] Date of Patent: Oct. 4, 1994

[54] PAPER FOOD CONTAINER HAVING A BOTTOM SECTION FORMED WITH A FLANGE

[76] Inventors: Yuan-Shin Liu, 11th-1 Floor, No. 90, Fu Hsin S. Road, Sec. 1, Tah An District, Taipei; Richard C. H. Chang, 19, Alley 2, Lane 685, Chung Cheng Road, Fuan Yuan City, Taichung Hsien, both of Taiwan

[21] Appl. No.: 115,115

[22] Filed: Sep. 2, 1993

[51] Int. Cl.[5] ..... B65D 5/24; B65D 5/40

[52] U.S. Cl. ..... 229/104; 229/1.5 B; 229/109; 229/169; 229/186

[58] Field of Search ..... 229/1.5 B, 104, 108, 229/109, 110, 169, 170, 186

[56] References Cited

U.S. PATENT DOCUMENTS

| | | | |
|---|---|---|---|
| 1,117,848 | 11/1914 | House | 229/104 |
| 1,497,661 | 6/1924 | Scotcher | 229/104 |
| 1,877,213 | 9/1932 | Willauer | 229/104 |
| 2,304,278 | 12/1942 | Poster | 229/1.5 B |
| 2,330,262 | 9/1943 | Biggs | 229/169 |
| 2,334,805 | 11/1943 | Barbieri | 229/104 |
| 2,407,118 | 9/1946 | Waters | 229/169 |
| 3,423,008 | 1/1969 | Mykleby | 229/186 |
| 3,767,108 | 10/1973 | Arneson | 229/1.5 B |
| 4,199,097 | 4/1980 | Christensson | 229/186 |
| 5,253,801 | 10/1993 | Bernstein et al. | 229/110 |

FOREIGN PATENT DOCUMENTS

| | | | |
|---|---|---|---|
| 1417025 | 12/1975 | United Kingdom | 229/109 |

*Primary Examiner*—Gary E. Elkins
*Attorney, Agent, or Firm*—Bacon & Thomas

[57] ABSTRACT

A paper food container is disclosed having a bottom flange and formed form a paper board blank. The blank has a predetermined thickness and is cut into a predetermined pattern. Since the container will accommodate food products, the paper board is made of pure fiber and additives meeting FDA regulations. The blank is coated with polyethylene and laminated to an adequate thickness. The paper board is further embossed with folding lines so that the paper board can be folded about the folding lines and heat-sealed to form a bowl-like paper food container having a bottom formed with a flange which reinforces the paper food container and permits a user to securely hold the paper food container without being burned by the heat of the hot food contained in the paper food container.

2 Claims, 3 Drawing Sheets

PAPER FOOD CONTAINER HAVING A BOTTOM SECTION FORMED WITH A FLANGE

BACKGROUND OF THE INVENTION

The present invention relates to a paper food container having a bottom section formed with a flange. The paper container is formed from a paper board which is cut into a predetermined pattern and embossed with separate folding lines which define a bottom section and several wall sections outward extending from the sides of the bottom section, whereby the paper pattern can be folded about the folding lines and heat-sealed through a mold to form a bowl-like paper container. The bottom of the paper container has a flange, which reinforces the paper container and permits a user to securely hold the paper container at the flange without feeling the heat of the hot food contained in the paper container.

Conventional disposable food containers currently used by fast food restaurants are mainly made of polymers. The polymer-made food containers can be easily manufactured at low cost. However, such food containers are not heat-resistant and not subject to natural decomposition and thus will cause serious detriment to the environment and the human health. Therefore, the polymer-made food containers are gradually substituted by the paper food containers. The paper food containers are made from a paper board which is cut into a predetermined pattern and embossed with folding lines to be folded and heat-sealed to form the paper food container. However, most of the conventional paper food containers lack leakproof design and therefore have limited practical usage. Some other paper food containers made from complete sheets of paper board are formed with plane bottoms without flanges, a user cannot stably hold the paper container. When the paper container contains a hot food, especially liquid hot food, the heat of the hot food will be easily conducted to the user's hand. Therefore, the conventional paper food containers are still undesirable and should be improved.

It is therefore tried by the applicant to develop a paper food container the bottom of which has a reinforcing flange structure to eliminate the above shortcomings existing in the conventional paper food container.

SUMMARY OF THE INVENTION

It is a primary object of the present invention to provide a paper food container having a bottom section formed with a flange. The paper container is formed from a complete sheet of paper board which is cut into a predetermined pattern and embossed with folding lines which define a bottom section and several wall sections outward extending from the sides of the bottom section, whereby the paper board can be folded about the folding lines and heat-sealed through a mold to form a bowl-like paper container. The bottom of the paper container has a flange which reinforces the paper container and permits a user to securely hold the paper container without feeling the heat of the hot food contained in the paper container. As a result, better practical utility can be achieved by the paper container of the present invention.

BRIEF DESCRIPTION OF THE DRAWINGS

The structure, features, functions, and other objects of the present invention, and the technical means adopted to achieve the present invention can be best understood through the following detailed description of the preferred embodiment and the accompanying drawings wherein.

DETAILED DESCRIPTION OF THE PREFERRED EMBODIMENTS

The paper food container of the present invention is formed from a paper board which has a predetermined thickness and is cut into a predetermined pattern. The paper board is made of pure fiber and additives meeting FDA regulations, being coated with polyethylene and then laminated to an adequate thickness. The paper board is also embossed with separate folding lines which define a bottom section 11 and several wall sections 13 outward extending from the sides of the bottom section 11, whereby the paper board can be folded about the folding lines and heat-sealed to form a paper container 1 the bottom of which has flanges.

Figure 1:
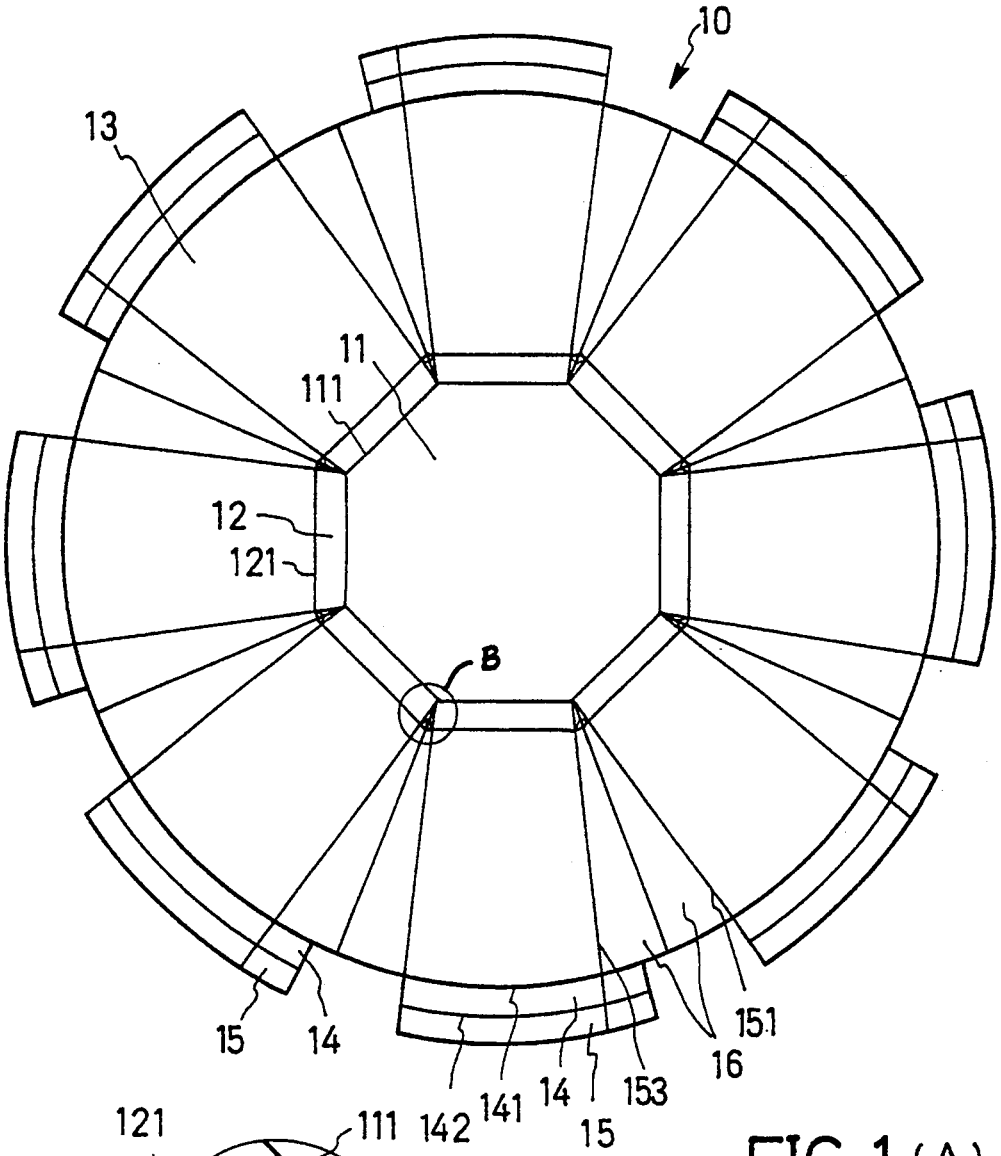
FIG. 1A is a stretched plane view of the paper container of the present invention.
Figure 1:
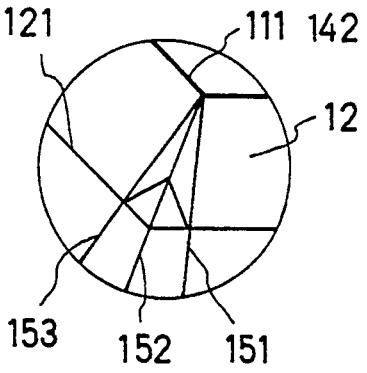

Please now refer to FIG. 1 which shows a stretched paper board 10 for forming the paper container 1 of the present invention, wherein the paper board 10 is embossed with a plurality of folding lines which divide the paper board 1 into a middle polygonal bottom section 11, several flange sections 12 adjoining respective sides of the bottom section 11 at folding lines 111, and several wall sections 13 adjoining the flange sections 12 at folding lines 121. Several inner folding edge sections 14 further adjoin respective wall sections 13 at folding lines 141 and several outer folding edge sections 15 further adjoin respective inner folding edge sections 14 at folding lines 142. Each two adjacent wall sections 13 contain an overlapping section 16.

Figure 2:
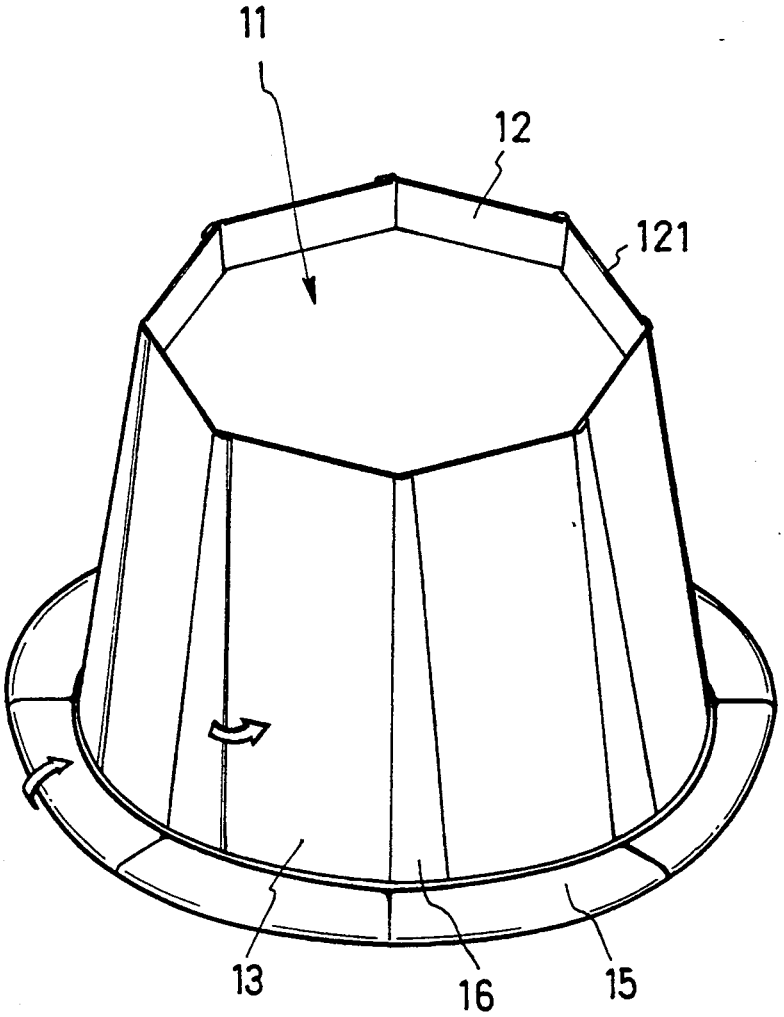
FIG. 2 shows the manner in which the paper container of FIG. 1 is folded.
Figure 3:
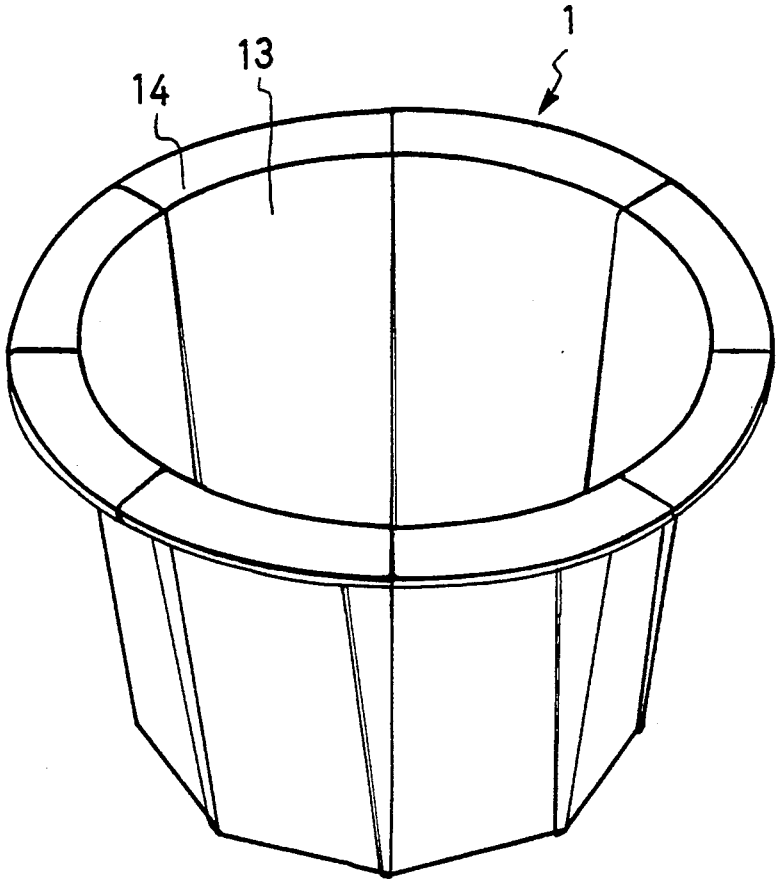
FIG. 3 shows a completed paper container which is obtained after being folded according to FIG. 2 and then heat-sealed.

Please now refer to FIG. 2. The paper board 10 is folded to form the paper container 1 in such a manner that the paper board 10 is pressed into a molding device which folds the wall sections 13 upward about the folding lines 121 and overlaps the overlapping sections 16 to closely attach onto the wall sections 13. Meanwhile, the inner folding edge sections 14 is folded outward about the folding lines 141 and the outer folding edge sections 15 are folded downward and inward to attach under the inner folding edge sections 14. After the above folding and overlapping procedure, a portion of the folded inner and outer folding edge sections 14, 15, which adjoins the overlapping section 16 is inserted into and heat-sealed on an inner side of the other portion of the folded inner and outer folding edge sections 14, 15 which adjoins the wall section 13 to form a substantially circular reinforced outer edge of the bowl-like paper container 1.

Moreover, the flange sections 12 are folded, overlapped and heat-sealed to form an extending flange of the bottom section 11 of the bowl-like paper container 1 (as shown in the enlarged portion of FIG. 1), whereby after the paper container 1 is completely formed, in addition to the supporting effect created by the overlapped flange sections 12, the overlapping sections 16 closely attached on the wall sections 13 provide a reinforcing effect on the wall sections 13 of the paper container 1, so that the paper container 1 is strengthened to contain foods in a more reliable and safe manner.

Therefore, according to the above arrangements, the edge of the bottom section 11 of the paper container 1 is formed with secure flange such that when the paper container is used to contain a hot food, a user can securely hold the paper container at the flange of the bottom section 11 without being burned by the heat of the hot food passing through the paper container 1. Moreover, when the paper container 1 contains foods, the flange of the bottom section 11 permits the paper container 1 to be stably placed on a table.

In conclusion, the paper container of the present invention has a bottom section formed with a flange which reinforces the paper container and permits the same to be easily placed and taken. Therefore, the paper container of the present invention is advantageous over the conventional bowl-like paper container which has a plane bottom without any reinforcing section and cannot be easily placed or taken and in which when hot foods are contained, the heat of the hot foods will be easily conducted to the user's hand.

It is to be understood that the above description and drawings are only used for illustrating one embodiment of the present invention, not intended to limit the scope of the present invention. Any variation and derivation from the above description and drawings should be included in the scope of the present invention.

What is claimed is:

1. A food container formed form a unitary paper board blank and comprising:

a) a bottom having a substantially planar, polygonal configuration with a plurality of sides;

b) a flange section foldably attached to each of the plurality of sides;

c) a wall section having an upper edge and a lower edge foldably attached to each flange section such that the wall sections and bottom define an interior of the food container, whereby the flange sections extend from the bottom in a direction away from the interior of the food container;

d) an inner folding edge section foldably attached to the upper edge of each wall section and extending outwardly from the interior of the food container;

e) an outer folding edge section foldably attached to each inner folding edge section and extending in contact with and parallel to the inner folding edge section; and f) a polyethylene coating applied to the bottom, the flange sections, the wall sections, the inner folding edge sections and the outer folding edge sections such that they are held in position by heat sealing.

2. A unitary blank of paper board material for forming a food container, comprising:

a bottom having a substantially planar, polygonal configuration with a plurality of sides;

b) a flange section extending outwardly from each side of the bottom and forming a first fold line therebetween;

c) a wall section extending outwardly from each flange section and forming a second fold line therebetween;

d) an inner folding edge section extending outwardly from each wall section and forming a third fold line therebetween;

e) an outer folding edge section extending outwardly from each inner folding section and forming a fourth fold line therebetween;

f) an overlapping section extending between two adjacent wall sections and defining fifth and sixth fold lines between an overlapping section and the two adjacent wall sections; and g) a coating of polyethylene material.

* * * * *